US010240792B2

(12) United States Patent
Ryon et al.

(10) Patent No.: US 10,240,792 B2
(45) Date of Patent: Mar. 26, 2019

(54) DIRECTIONALLY BIASED VALVE

(71) Applicant: Delavan Inc., West Des Moines, IA (US)

(72) Inventors: Jason A. Ryon, Carlisle, IA (US); Chien-Jung Yu, Clive, IA (US); Philip E. O. Buelow, West Des Moines, IA (US); Neal A. Thomson, West Des Moines, IA (US)

(73) Assignee: Delavan Inc., West Des Moines, IA (US)

( * ) Notice: Subject to any disclaimer, the term of this patent is extended or adjusted under 35 U.S.C. 154(b) by 0 days.

(21) Appl. No.: 15/790,750

(22) Filed: Oct. 23, 2017

(65) Prior Publication Data

US 2018/0058695 A1 Mar. 1, 2018

Related U.S. Application Data

(62) Division of application No. 13/872,970, filed on Apr. 29, 2013, now abandoned.

(51) Int. Cl.
*F16K 15/00* (2006.01)
*F23R 3/28* (2006.01)

(52) U.S. Cl.
CPC ..... *F23R 3/28* (2013.01); *F23K 2301/206* (2013.01); *F23K 2401/201* (2013.01); *F23K 2900/05001* (2013.01)

(58) Field of Classification Search
CPC ..... B01F 5/0682; B01F 5/0688; F15D 1/025; F23R 3/28
See application file for complete search history.

(56) References Cited

U.S. PATENT DOCUMENTS 3,526,391 A * 9/1970 Church, Jr. ..... B01F 5/0604 366/340
6,530,684 B1 * 3/2003 Kolb ..... A61K 9/1075 138/40
8,523,141 B2 * 9/2013 Elliott ..... F16K 47/08 251/127

* cited by examiner

*Primary Examiner* — Reinaldo Sanchez-Medina
(74) *Attorney, Agent, or Firm* — Locke Lord LLP; Scott D. Wofsy; Joshua L. Jones

(57) ABSTRACT

A valve for regulating fluid flowing bidirectionally therethrough includes a first flow body defining a passage configured to direct fluid flow in a downstream direction defined from the inlet to the outlet. The inlet includes an enlargement configured to provide decreased resistance to fluid flow in the downstream direction relative to flow in an upstream direction opposite the downstream direction.

9 Claims, 3 Drawing Sheets

DIRECTIONALLY BIASED VALVE

CROSS-REFERENCE TO RELATED APPLICATION

This application is a divisional application of, and claims the benefit of priority under 35 U.S.C. § 119(e) to, U.S. application Ser. No. 13/872,970, filed Apr. 29, 2013, the contents of which is incorporated herein by reference in its entirety.

BACKGROUND OF THE INVENTION

1. Field of the Invention

The present invention relates to valves, and more particularly, to bidirectional valves which bias fluid flow in one direction relative to another.

2. Description of Related Art

Bidirectional valves used to bias fluid flow in one direction relative to another typically utilize multiple moving parts (e.g., a translatable piston) to change the volume of a given flow path, and thus the pressure and resistance to fluid flow associated with the given flow path. In such applications, frictional bias and momentum of the fluid flow through the given flow path can resist changes in movement (e.g., translation) of the piston, resulting in hysteresis of the valve over time, as well as undesired flow patterns and valve configurations. Additionally, such bidirectional valves typically require tight manufacturing tolerances to function properly. Changes in entrance edge conditions to pathways in the valve caused by manufacturing processes can cause unwanted variation in flow-field behavior and flow rate. For example, deburring processes and tooling limitations in applications which require tight tolerances can impact geometries of leading edges of passages extending through the valve, especially when drilled at an angle relative to a flat surface, or through convex or concave surfaces.

Such conventional methods and systems have generally been considered satisfactory for their intended purpose. However, there is still a need in the art for a systems and methods that allow for easier and more efficient manufacturing, installation, and operation of bidirectional valves.

SUMMARY OF THE INVENTION

A valve for regulating bidirectional fluid flow is provided. The valve includes a first flow body defining a passage therethrough having an inlet, an opposed outlet, and a bore fluidly coupling the inlet and outlet. The passage of the first flow body is configured to direct fluid flow in a downstream direction defined from the inlet to the outlet. The inlet includes an enlargement configured to provide decreased resistance to fluid flow in the downstream direction relative to flow in an upstream direction opposite the downstream direction.

In certain embodiments, a second flow body is operatively associated with the first flow body. The first and second flow bodies together define a chamber therebetween in fluid communication with the inlet of the first flow body. The second flow body can define a passage for bidirectional fluid flow therethrough with an inlet on one side thereof and an outlet on an opposite side thereof leading to the chamber. The inlet of the second flow body can include an enlargement configured to bias fluid flow therethrough in the downstream direction toward the chamber and first flow body relative to flow in the upstream direction. The passages of the first and second flow bodies can also define respective axes offset from one another in order to promote bias in fluid flow in the downstream direction.

In certain embodiments, a third flow body, like the first and second flow bodies described above, is operatively associated with the second flow body. The second and third flow bodies together define an additional chamber therebetween in fluid communication with the inlet of the second flow body.

In accordance with certain embodiments, the first, second, and third flow bodies are static and are mounted to one another in a stacked configuration. In such embodiments, the volumes of the chambers between flow bodies can remain constant.

In certain embodiments, the second flow body is disposed radially outward of the first flow body such that the passage of the first flow body directs fluid bidirectionally in a radially downstream direction defined from the inlet to the outlet, and in a radially upstream direction opposite the downstream direction. In such embodiments, the first and second flow bodies can define an annular damping chamber therebetween in fluid communication with the inlet of the first flow body, whereby downstream fluid flow is radially inward, and upstream fluid flow is radially outward. The inlet of the first flow body can include an enlargement configured to provide decreased resistance to fluid flow in the radially downstream direction relative to the radially upstream direction. The first and second flow bodies can be translatable relative to one another to increase size of the annular chamber during radially upstream fluid flow, and to decrease size of the annular chamber during radially downstream fluid flow. The flow bodies can be configured to form sealed bearings on opposite sides of the annular chamber, and to provide increased damping of fluid flow in the upstream direction relative to the downstream direction.

In accordance with certain embodiments, the first flow body can define a plurality of additional radially extending passages fluidly coupled to the annular damping chamber, longitudinally offset from one another, and configured to provide decreased resistance to fluid flow in the radially downstream direction relative to the radially upstream direction. The flow bodies can be configured such that translation relative to one another blocks at least one radially extending passage defined in the first flow body to increase resistance to fluid flow in the radially upstream direction.

These and other features of the systems and methods of the subject invention will become more readily apparent to those skilled in the art from the following detailed description of the preferred embodiments taken in conjunction with the drawings.

BRIEF DESCRIPTION OF THE DRAWINGS

So that those skilled in the art to which the subject invention appertains will readily understand how to make and use the devices and methods of the subject invention without undue experimentation, preferred embodiments thereof will be described in detail herein below with reference to certain figures, wherein.

DETAILED DESCRIPTION OF THE PREFERRED EMBODIMENTS

Figure 1:
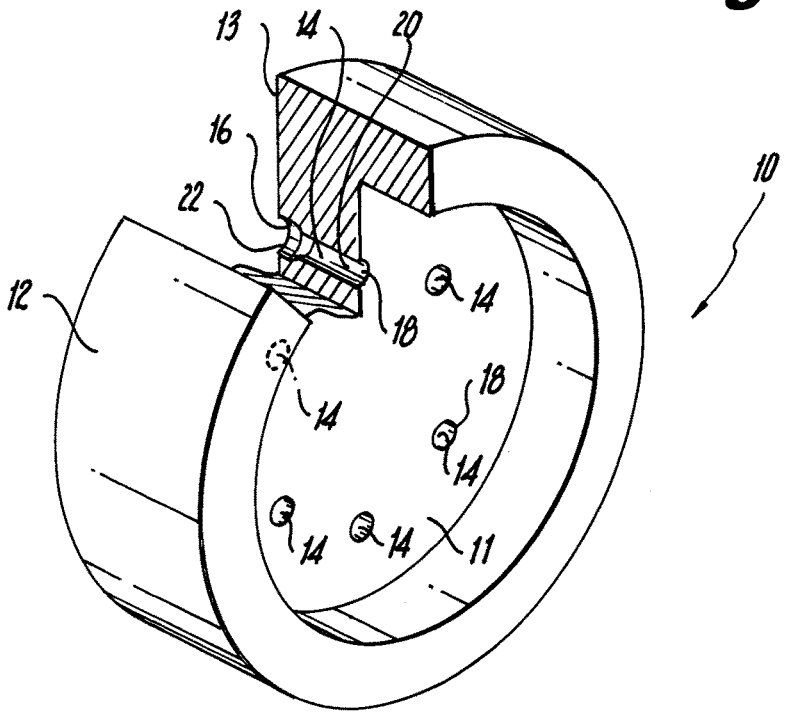
FIG. 1 is a perspective view of a valve for regulating fluid flowing bidirectionally therethrough, constructed in accordance with an exemplary embodiment of the present invention and showing a flow body which defines a plurality of passages therethrough, each including an inlet, an opposed outlet, and a bore fluidly coupling the inlet and outlet.

Reference will now be made to the drawings, wherein like reference numerals identify similar structural features or aspects of the subject invention. For purposes of explanation and illustration, and not limitation, a partial view of an exemplary embodiment of a valve for regulating bidirectional fluid flow in accordance with the invention is shown in FIG. 1, and is designated generally by reference character 10. Other embodiments of valves or valve assemblies in accordance with the invention, or aspects thereof, are provided in FIGS. 2-6, as will be described.

The valve 10 includes a first flow body 12 defining a plurality of passages 14 therethrough. Each passage 14 has a respective inlet 16, an opposed outlet 18, and a bore 20 fluidly coupling inlet 16 and outlet 18. Each passage 14 of first flow body 12 is configured to direct fluid flow in a downstream direction from inlet 16 to outlet 18, with an opposed upstream direction defined from outlet 18 to inlet 16. Inlet 16 includes an enlargement 22 configured to provide decreased resistance to fluid flow in the downstream direction relative to the upstream direction. The enlargements 22 facilitate fluid entry into the passages 14 by defining wider openings which catch and direct downstream fluid flow therethrough. By contrast, the outlets 18 define smaller openings, and thus are less able to facilitate upstream fluid entry into the passages 14 compared to the inlets 16, especially when fluid is moving at an angle relative to the axes of passages 14. The enlargements can be configured to reduce entrance edge conditions imparted on the fluid flow, which also biases fluid entry into the passages 14 in the downstream direction as further discussed below.

Figure 2:
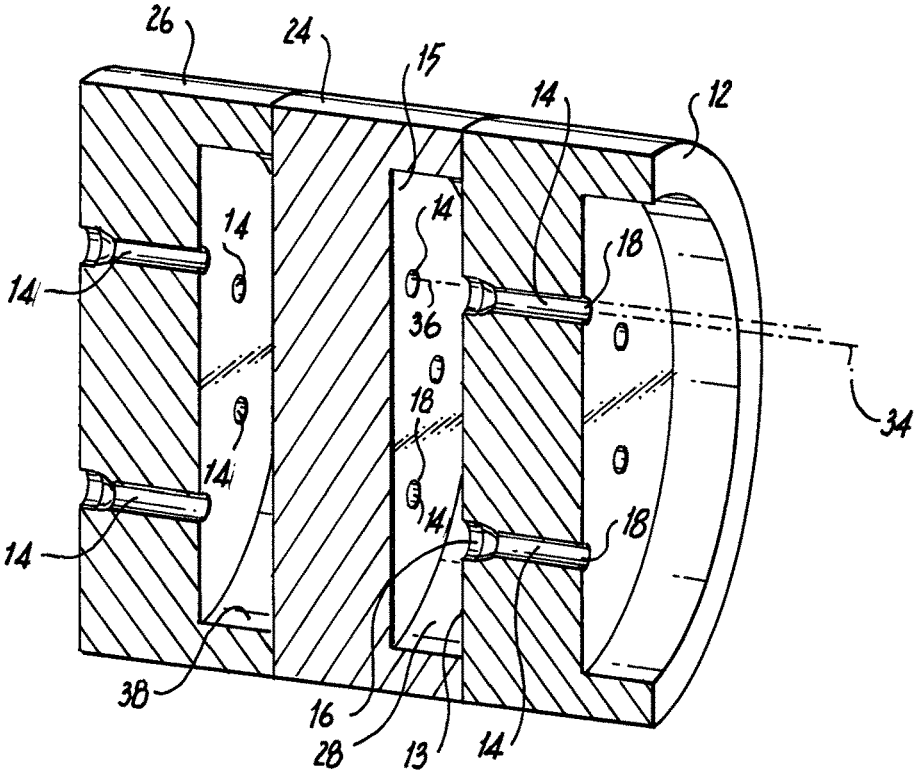
FIG. 2 is a perspective sectional view of an assembly of three valves like the valve shown in FIG. 1 arranged in a stacked configuration with the second middle valve rotated relative to the first and third valves on opposite sides thereof such that the passages of the valves are circumferentially offset relative to one another.

Referring now to FIG. 2, a second flow body 24 is shown mounted to first flow body 12, and a third flow body 26 is shown mounted to second flow body 24 such that the first, second, and third flow bodies 12, 24, and 26 are arranged in a stacked configuration. The first and second flow bodies 12, 24 define a chamber 28 in fluid communication with inlets 16 of first flow body 12. Second flow body 24 is constructed the same as first flow body 12. The respective passages 14 of the first and second flow bodies 12 and 24 define respective axes 34, 36 that are offset circumferentially from one another to enhance the bias in fluid flow in the downstream direction (e.g., from the second flow body 24 toward the chamber 28 and first flow body 12) as explained below.

Fluid exiting outlets 18 of the second flow body 24 must change direction upon exiting flow body 24 in order to reach inlets 16 of the first flow body 12, and may additionally strike opposing wall 13 of the first flow body 12 prior to reaching inlets 16. This offsetting of the passages 14, 30 therefore enhances the bias in fluid flow in the downstream direction because when the fluid changes direction, it must enter opposing inlets at an angle, and the effect of the enlarged inlets to facilitate fluid transfer in the downstream direction therethrough is even further enhanced. It will be appreciated that such offsetting can be done vertically, horizontally, radially, or in any other suitable direction or combination of directions. Additionally, it will be appreciated that variations in diameter and length of the passages 14 and the axial length of the chamber 28 can further influence biasing of the fluid flow downstream as needed for specific applications.

Second and third flow bodies 24, 26 define an additional chamber 38 therebetween in fluid communication with inlets (hidden) of second flow body 24. Third flow body 26 may be constructed similarly to first flow body 12, and is mounted to second flow body 24 in the same manner as second flow body 24 is mounted first flow body 12. It will be appreciated that first, second, and third flow bodies 12, 24, 26, as well as chamber 28 and chamber 38 are static (e.g., they do not move relative to one another and do not change in size, shape, or orientation relative to one another), yet work together to bias fluid flow in the downstream direction. As shown, the second flow body 24 is rotated relative to the first and third flow bodies 12, 26 such that the respective passages 14, 30, 40 of the flow bodies 12, 24, 26 are offset circumferentially relative to one another. Such offsetting can be done in any other suitable manner as discussed above.

It is anticipated that bidirectional valve 10 can be used, for example, for fuel circuit control on a fuel nozzle for a gas turbine engine. If fluid is travelling downstream, the discharge coefficient ($C_D$) may be around 0.85 for each drilled passage 14 due to improved entrance effects at inlets 16. However, if the flow is reversed (e.g., upstream from outlet 14 to inlet 16, the discharge coefficient may be reduced to around 0.70, which corresponds to a restriction of approximately 20% to reverse flow.

Stacking of the valves 10 as shown in FIG. 2 will provide additional bias as described above. Such bias has been found to be approximately a 30% restriction against upstream flow, and increases further upon the stacking of additional valves 10. The stacked configuration of FIG. 2 can be used, for example, for a check valve or fuel control valve where bias against reversed flow is desired, and is advantageous in terms of simplicity of manufacturability of the hardware and assembly. Potential applications include, for example, recirculating manifolds, tertiary cavity purge, control valves with damping, flow control valves, and manifold check valves. Additionally, it will be appreciated that if the valve 10 is utilized in a reversed flow orientation, it provides a high restriction device which is likely less sensitive to manufacturing tolerances than traditional components. Those skilled in the art will readily appreciate that the applications described herein are exemplary only, and that the systems and methods disclosed herein can be used in any other suitable application without departing from the scope of this disclosure.

Figure 3:
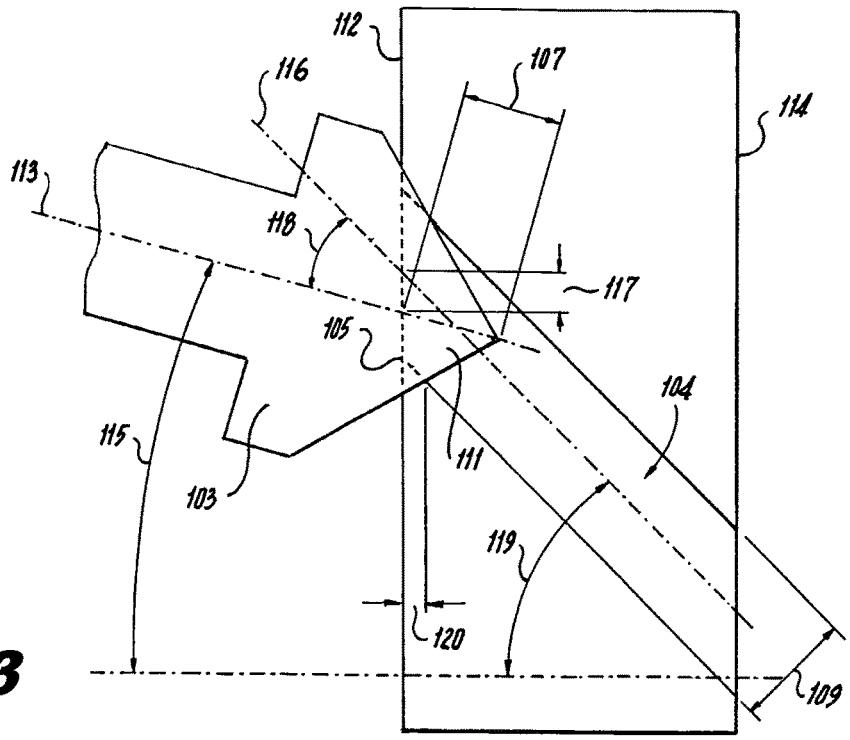
FIGS. 3-5 are schematics showing exemplary embodiments of enlargements of inlets to bores or passages in accordance with the present invention.
Figure 4:
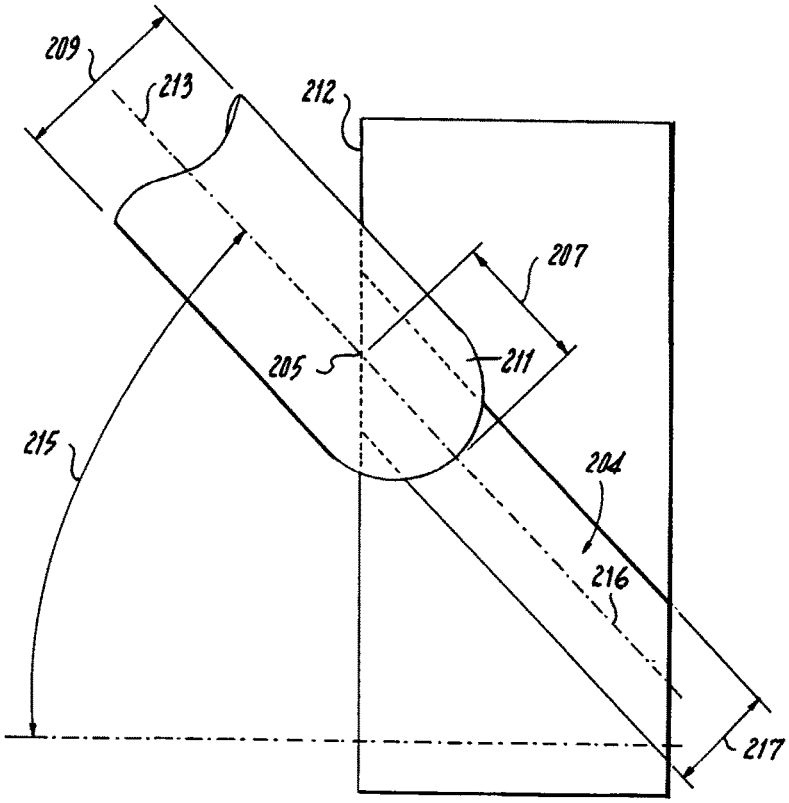
Figure 5:
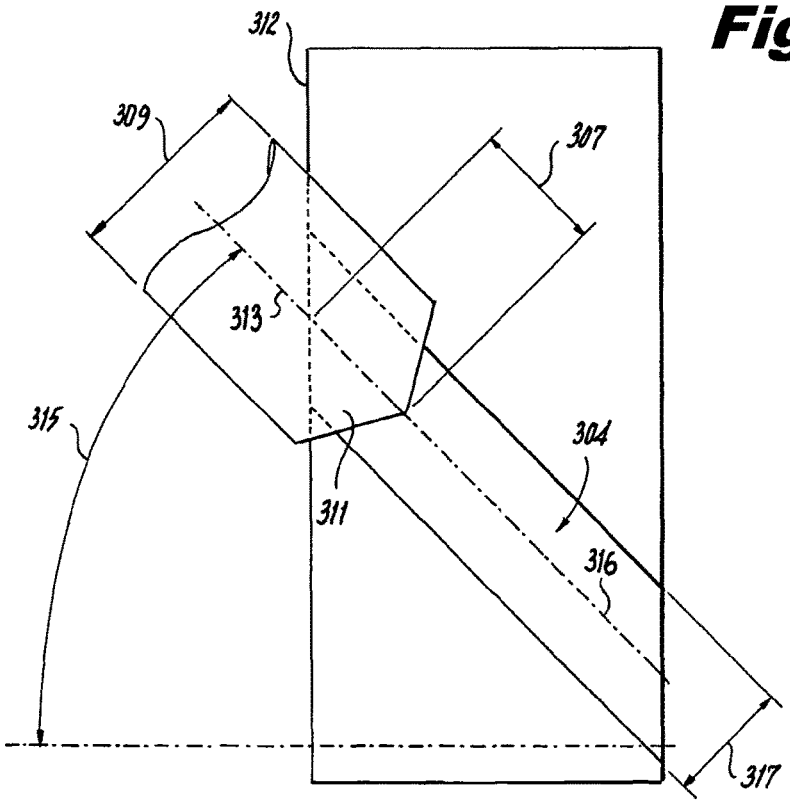

With reference now to FIGS. 3-5 with continued reference to FIGS. 1 and 2, the enlargements of the inlets of the flow bodies described above may be constructed by any suitable means, and in any dimensions suitable for reducing sensitivity to entrance edge conditions of the passages. It will be appreciated that while the passages (e.g., 14) are shown oriented generally perpendicular to generally flat front and rear surfaces 11, 13 of the flow body 12, such front and rear surfaces 11, 13 may be convex, concave, or any other shape, the passages may be oriented at an angle relative to the front and rear surfaces 11, 13, and the enlargements 22 of the inlets 14 may be formed off axis.

For example, various types of enlargements (e.g., such as those shown in FIGS. 3-5), which correspond to FIGS. 2, 3, and 4 of commonly assigned U.S. application Ser. No. 13/714,270, may be utilized. As shown in FIG. 3, an enlargement may formed as a chamfer 111 which has a larger cross-sectional area than that of a passage or bore 104 downstream of the chamfer 111. It will be appreciated by those skilled in the art that certain geometries may make it difficult to form a radially constant chamfer size through an inlet surface 112 of a given flow body. However, the critical portion of the edge of a given bore 104 is the one where the fluid flow must turn the greatest degree (e.g., the most acute/sharp edge of the oblate shaped entrance to the cylindrical hole). This portion of the edge and the upstream portion of the cylindrical bore 104 (absent the chamfer 111) is shown in phantom in FIG. 3, further discussed below, at reference character 105. Examples of such structures are disclosed in, for example, commonly assigned U.S. Patent Pub. No. 2012/0228405, which is hereby incorporated by reference in its entirety. Edge portion 105 is the key portion of the edge of the initially cylindrical bore 104 for which the chamfer 110 must be defined and controlled to achieve desired effects. The remainder of the entrance edge to the initially cylindrical bore 104 is generally less sensitive. The chamfer 111 can be created by using a chamfering bit 103 with proper orientation to achieve the desired chamfering effect.

The chamfer 111 is formed along a chamfer axis 113 into an inlet surface 112, and thus eliminates the sharp edge 105 of the angled bore 104. The chamfer 111 and bore 104 can be formed in any order, but the chamfer 111 will generally be formed after the bore 104 is formed. The chamfer 111 may be formed such that the chamfer angle 115 (relative to the normal of the inlet surface 112 of the flow body) is different than the bore angle 119. As shown, the chamfer angle 115 is less than the bore angle 119. In this case, the chamfer angle 115 is such that the relative angle 118 between the chamfer axis 113 and the bore axis 116 is about forty degrees, though other chamfer angles may be utilized. The chamfer 111 preferably has a depth 107 equal to or larger than about 15% of the diameter 109 of the bore 104, which renders it of sufficient size to substantially eliminate flow variation from bore to bore. The chamfer edge depth 120 is the depth of the edge-break on the acute-angle location of the entrance edge. The chamfer depth 107 is measured from the very tip of the chamfer bit to the inlet surface 112, along the chamfer axis 113. The chamfer edge depth 120 is measured from the inlet surface 112 along a normal thereto. The chamfer depth 107 and offset 117 are preferably adjusted such that the acute angled edge 105 of the original bore 104 is cut to a chamfer edge depth 120 of about 15% of the downstream bore diameter 109. If the bore angle 119 is 0°, then the chamfer angle 115 can be aligned with the bore angle 119. A chamfer edge depth 120 less than 15% may also be utilized, especially where surface geometry does not allow for depths larger than 15% on account of close proximity of entrance edges of multiple bores.

The discharge coefficient of fluid in a cylindrical bore varies less significantly once the depth of the chamfer exceeds 15% of the bore diameter downstream of the chamfer. For example, using a 0.031 inch diameter bore, increase in discharge coefficient of a fluid in the cylindrical bore varies minimally with increase in chamfer depth once the chamfer depth is over 0.005 inches.

Continuing with FIG. 3, the bore 104 can define a longitudinal axis 116 that is angled relative to the inlet surface 112 and the outlet surface 114. It will be appreciated that for bores which are predominantly perpendicular to the entrance surface (e.g., such as passages 14, 30, and 40 of FIGS. 1-2), the axis of a chamfering bit could be essentially aligned with the axis of the passage. Other chamfering angles and depths may be utilized.

With reference now to FIG. 4, an enlargement may alternatively be formed as a countersink 211 which has a larger cross-sectional area than that of the bore 204 downstream of the countersink 211. The bore 204 extends between an inlet surface 212 in which the inlet 208 of the bore is defined, and an opposed outlet surface 214 in which the outlet 206 of the bore 204 is defined.

The countersink 211 may be formed using a ball-nose endmill as shown. The countersink 211 can extend along a countersink axis 213 which is angled relative to the inlet surface 212, and substantially collinear with a longitudinal axis 216 of the bore 204. The endmill can alternatively be oriented at a different angle than the angle 215 of the downstream bore 204 to produce a countersink axis 213 oriented similar to chamfer axis 113 of FIG. 3 relative to the the bore axis. The countersink 211 preferably has a diameter 209 between about 30% and about 75% greater than that of the bore 204 downstream of the countersink 211. The countersink 211 can have a depth 207 anywhere between about 15% to about 100% of the diameter of the bore 204 downstream of the countersink 211, and provides the flow uniformity described above. The countersink depth 207 varies depending upon the angle 215 of the downstream bore 204 relative to the inlet surface 212. For example, the steeper the angle 215, the deeper the countersink depth 207. The countersink depth 207 is preferably large enough to alter the entire entrance edge of the original bore. As shown, the depth 207 is measured from the distal most end of the ball-nose to the inlet surface 212, along the countersink axis 213.

For example, for a 0° bore angle 215, the countersink depth 207 can be about 15% of the downstream bore diameter 209. If the bore angle 215 is 60°, the countersink depth 207 can be about 100% of the downstream bore diameter 217. The countersink depth 207 is preferably sufficient to cut the acute angle edge (shown in phantom) of the original bore 204 by the ball-nose endmill to provide improved flow. The countersink 211 is preferably of sufficient diameter and depth to yield an effect similar to the chamfer described above, and effectively creates an aerodynamic chamfer. The countersink 211 can alternatively be formed using a flat end-mill, a drill, or any other suitable boring device.

With reference now to FIG. 5, a countersink 311 formed using a drill is shown. The countersink 311 extends along a countersink axis 313 which is angled relative to the inlet surface 312, and can be formed substantially collinear with a longitudinal axis 316 of the bore 304. The countersink axis 311 can alternatively be formed at an angle relative to the longitudinal axis 316 of the bore 304. The countersink 311 preferably has a diameter 309 between about 30% and about 75% greater than that of the bore 204 downstream of the countersink 311. The countersink 311 can have a depth 307 anywhere between about 15% to about 100% of the diameter of the bore 304 downstream of the countersink 311, and provides the flow uniformity described above. The countersink depth 307 varies depending upon the angle 315 of the downstream bore 304 relative to the inlet surface 312 as described above.

It has been determined that a ball-nose end-mill, as opposed to a drill-point, yields a higher flow-rate and reduced flow sensitivity for a given end-mill size. Ball-nosed end-mills of diameter about 30%-75% greater than that of the bore or passage can be used to increase the discharge coefficient by about 13%-23%. It has also been determined that a diameter ratio (ratio of end-mill diameter to bore diameter) of 1.6 yields better results than a diameter ratio of 1.3, and that a ball-nose end-mill with a 1.6 diameter ratio has a very low sensitivity to entrance-edge condition of the countersink. Similarly, drills of diameter of about 30%-75% greater than that of the bore can be used to increase the discharge coefficient by about 13%-20%.

It will be appreciated that by including some form of enlargement (e.g., chamfer or counter-sink) at the lead-in (e.g., the inlet surface), the variability in flow from bore to bore is greatly reduced, and has been found to be less than about 5%, largely due to variations in edge-breaks leading into the counter-bores.

While described above in the exemplary context of circular geometry, those skilled in the art will readily appreciate that non-circular geometries can also be used without departing from the scope of the invention. In the case of a non-circular bore, the desired depth of a particular enlargement will also be proportional to and correspond to the square root of a cross-sectional area of the bore downstream of the enlargement.

It will be appreciated that the above described enlargements are exemplary only, and that any type of enlargement of any shape and size can be utilized in accordance with the present invention (e.g., with respect to the embodiments of FIGS. 1-2 discussed above, and FIG. 6, further discussed below). It has been found that use of a Bell Mouth or Ball Nose end-mill to form the enlargements produces superior results in terms of biasing fluid flow direction.

Figure 6:
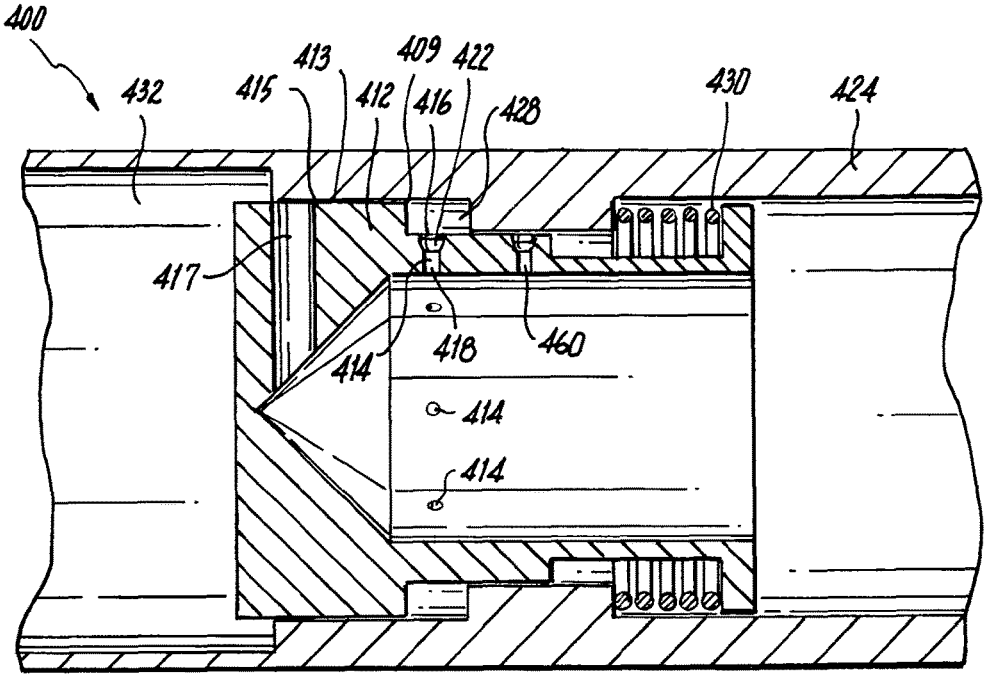
FIG. 6 is a cross-sectional side elevation view of another exemplary embodiment of a valve for regulating fluid flowing bidirectionally therethrough, showing a first flow body which defines a plurality of radial passages therethrough, and a second flow body operatively associated with the first flow body and disposed radially outward thereof.

With reference now to FIG. 6, a valve 400 is shown in which the second flow body 424 is disposed radially outward of the first flow body 412. The passage 414 of the first flow body 412 is configured to direct fluid flow in a radially inward direction from the inlet 416 to the outlet 418, and in a radially outward direction from the outlet 418 to the inlet 416 in much the same manner as described above. The first and second flow bodies 412, 424 define an annular damping chamber 428 therebetween in fluid communication with the inlet 416 of the first flow body 412. In this manner, downstream fluid flow is radially inward, and upstream fluid flow is radially outward. The inlet 416 includes an enlargement 422 configured to provide decreased resistance to fluid flow in the radially inward (downstream) direction relative to fluid flow in the radially outward (upstream) direction.

The first flow body 412 is configured as a piston which is longitudinally translatable relative to the second flow body 424 to increase and decrease the size of the annular damping chamber 428. When the first flow body 412 is in the position of FIG. 6, fluid cannot escape through vertically oriented passage 417, but can travel through outlet 418, passage 414, and inlet 416 into damping chamber 428 to increase the size thereof against the bias of the spring 430. As valve 400 opens (e.g., as first flow body 412 translates to the left relative to second flow body 424), the direction of flow into damping chamber 428 is allowed but at a restricted rate due to passages 414 compared to the rate in the reverse direction (e.g., from damping chamber 228 through passages 414 toward outlets 418) when valve 400 is closing. It will be appreciated that when fluid flow changes direction, radially inward downstream flow of fluid from the chamber 428 is aided by the enlargement 422 of the inlet 416.

The flow bodies 412 and 424 are configured to form a sealed bearing 409 adjacent annular chamber 428. In particular, edges (e.g., opposed match grind surfaces 413 and 415) of the flow bodies 412 and 424 allow a miniscule amount of fluid to flow therethrough for relatively sealed translation of the flow bodies 412 and 424 relative to one another. It will be appreciated that the flow rate allowed by the annular damping chamber in the upstream and downstream directions will act as a damper to the forces provided by the spring 430 and longitudinal fluid flow driving the piston. Additionally, the rate at which the damping chamber 428 expands will be slower than the rate at which it closes because of the directional bias of the passage 414.

In certain embodiments, the first flow body can define a plurality of additional radially extending passages 460 which are intermittently fluidly coupled to the annular damping chamber 428, and longitudinally offset from passage 414. Passages 460 become fluidly isolated from the damping chamber 428 when flow body 412 is in the position shown in FIG. 6. In this manner, translation of the flow bodies 412, 424 can be designed to selectively fluidly couple passages 460 to damping chamber 428 as needed to increase or decrease resistance to fluid flow in the radially upstream (outward) direction. It will be appreciated that this may reduce or eliminate valve hysteresis, which can result in improved life on, for example, an engine, and may allow the valve 400 to be opened faster than a traditionally damped valve. Similar to the embodiments of the invention shown above with respect to FIGS. 1-2, various types of enlargements (e.g., the enlargements of FIGS. 3-5 or enlargements of other shapes and sizes) can be utilized for the inlets of FIG. 6.

While the apparatus and methods of the subject invention have been shown and described with reference to preferred embodiments, those skilled in the art will readily appreciate that changes and/or modifications may be made thereto without departing from the spirit and scope of the subject invention. For example, while particular shapes, sizes, dimensions, proportions, and orientations of bore holes, passages, chamfers, countersinks, and flow bodies have been disclosed, it will be appreciated that other shapes, sizes, dimensions, proportions, and orientations may be utilized. It will also be appreciated that greater control and consistency of flow-field behavior and flow rate using the present invention may be achieved whether the fluid flow is gaseous, liquid, or both, and whether the application is for gas turbine fuel injectors or other technologies. Thus, it will be appreciated that changes may be made without departing from the spirit and scope of the invention as claimed.

What is claimed is:

1. A valve for regulating fluid flowing bidirectionally therethrough, comprising:

a first flow body defining a passage therethrough which includes an inlet, an opposed outlet, and a bore fluidly coupling the inlet and outlet, the passage configured to direct fluid flow in a radially downstream direction defined from the inlet to the outlet, wherein the inlet includes an enlargement configured to provide decreased resistance to fluid flow in the radially downstream direction relative to flow in a radially upstream direction opposite the downstream direction; and a second flow body operatively associated with and disposed radially outward of the first flow body, the first and second flow bodies defining an annular chamber therebetween in fluid communication with the inlet of the first flow body, wherein the first and second flow bodies are translatable relative to one another to increase and decrease size of the annular damping chamber to provide increased damping of fluid flow in the radially upstream direction relative to the radially downstream direction, and wherein relative translation of the first and second flow bodies selectively fluidly couples the passage to the annular chamber.

2. A valve according to claim 1, wherein the first flow body defines a plurality of additional radially extending passages fluidly coupled to the annular damping chamber, the plurality of additional radially extending passages including two passages longitudinally offset from one another and configured to provide decreased resistance to fluid flow in the radially downstream direction relative to the radially upstream direction.

3. A valve according to claim 2, wherein the flow bodies are configured such that translation relative to one another causes blocking of at least one passage defined in the first flow body by the second flow body to increase resistance to fluid flow in at least one of the upstream and downstream directions.

4. A method of fuel circuit control on a fuel nozzle for a gas turbine engine, comprising:

at a bidirectional valve having a first flow body and a second flow body operatively associated with the first flow body, the first flow body defining a flow passage therethrough which includes an inlet, an opposed outlet, and a bore fluidly coupling the inlet and outlet, the inlet having an enlargement, wherein the enlargement has an axial length that is smaller than an axial length of a remainder of the bore coupling the inlet to the outlet, wherein an axial length to flow area width ratio of the remainder of the bore coupling the inlet to the outlet is greater than 1, receiving a downstream-directed fuel flow at the first flow body decreasing resistance to the downstream-directed fuel flow at the enlargement of the flow passage inlet defined by the first flow body;

communicating the fuel flow to the outlet of the flow passage through the bore fluidly coupling the flow passage inlet to the flow passage outlet;

issuing the fuel flow from the flow passage with a first discharge coefficient;

receiving a second fuel flow at the outlet of the first flow body;

communicating the second fuel flow to the inlet of the flow passage through the bore fluidly coupling the inlet to the outlet of the flow passage; and issuing the second fuel flow from the inlet of the flow passage with a second discharge coefficient, wherein the second discharge coefficient is lower than the first discharge coefficient.

5. The method as recited in claim 4, wherein the flow passage is a first flow passage, the flow body defining a second flow passage therethrough with an inlet, an opposed outlet, and a bore fluidly coupling the inlet and outlet, the inlet having an enlargement, the method further comprising:

flowing the downstream flow through the first flow passage in a radially inward direction; and flowing the upstream fluid flow in a radially outward direction through the second flow passage.

6. The method as recited in claim 4, further comprising increasing size of an annular damping chamber between the first flow body and the second flow body during upstream fluid flow; and decreasing size of the annular chamber during downstream fluid flow.

7. The method as recited in claim 4, further comprising providing increased damping of fluid flow in the upstream direction relative to the downstream direction.

8. The method as recited in claim 4, further comprising translating the first flow body relative the second flow body to increase size of an annular damping chamber between the first flow body and the second flow body during upstream fluid flow.

9. The method as recited in claim 4, further comprising translating the first flow body relative to the second flow to decrease size of an annular damping chamber between the first flow body and the second flow body during downstream fluid flow.

* * * * *